United States Patent [19]

Benatar et al.

[11] Patent Number: 4,497,599

[45] Date of Patent: Feb. 5, 1985

[54] SYSTEM FOR PREVENTING CLOGGING OF THE OUTLET ORIFICE OF A DISPENSER TANK CONTAINING POWDERED REAGENT AND AUXILIARY TANK DISCHARGE MEANS

[75] Inventors: Victor Benatar, Atlanta; Walter R. Wilburn, Calhoun, both of Ga.

[73] Assignee: Advance Engineering, Inc., Decatur, Ga.

[21] Appl. No.: 484,301

[22] Filed: Apr. 19, 1983

Related U.S. Application Data

[63] Continuation of Ser. No. 246,703, Mar. 23, 1981, abandoned.

[51] Int. Cl.[3] ..... B65G 53/46

[52] U.S. Cl. ..... 406/132; 222/149; 406/142

[58] Field of Search ..... 222/149, 151, 501, 546, 222/246; 406/130, 132, 134, 142, 146; 241/283

[56] References Cited

U.S. PATENT DOCUMENTS

| | | | |
|---|---|---|---|
| 1,832,692 | 11/1931 | Deligianes et al. | 222/149 X |
| 1,898,354 | 2/1933 | Pickey | 406/142 |
| 2,614,885 | 10/1952 | Roell et al. | 222/149 X |
| 2,699,363 | 1/1955 | Weinrich | 406/142 |
| 2,817,561 | 12/1957 | Planiol | 406/146 X |
| 3,053,420 | 9/1962 | De Saint-Martin | 406/132 X |
| 3,197,077 | 7/1965 | Amster | 222/149 |
| 3,407,972 | 10/1968 | Cymbalisty | 406/132 X |
| 3,463,553 | 8/1969 | Boucraft et al. | 406/146 X |

FOREIGN PATENT DOCUMENTS

| | | | |
|---|---|---|---|
| 607368 | 8/1948 | United Kingdom | 406/134 |

*Primary Examiner*—Jeffrey V. Nase

*Attorney, Agent, or Firm*—Rodgers & Rodgers

[57] ABSTRACT

A dispenser tank having an orifice and containing powdered reagent which is supplied through the tank orifice to a pool of molten metal for effecting desulphurization thereof is provided with a plunger arranged to reciprocate through the tank orifice so as to crumble lumps and foreign matter which may accumulate at the orifice and interfere with the free flow of powdered reagent therethrough and a cup shaped closure element is movable with the plunger and arranged to close and open the tank orifice due to reciprocable motion imparted to the closure element and plunger by a suitable operating means such as a cylinder and piston mounted within the dispenser tank and in order to unload the tank during emergency conditions a discharge conduit is arranged to extend through a wall of the tank and is controlled by a valve outside the tank so that pressure inside the dispenser tank may be used to blow the powdered reagent out of the tank and into a collection tank for temporary storage and subsequent use.

9 Claims, 5 Drawing Figures

Fig. 1
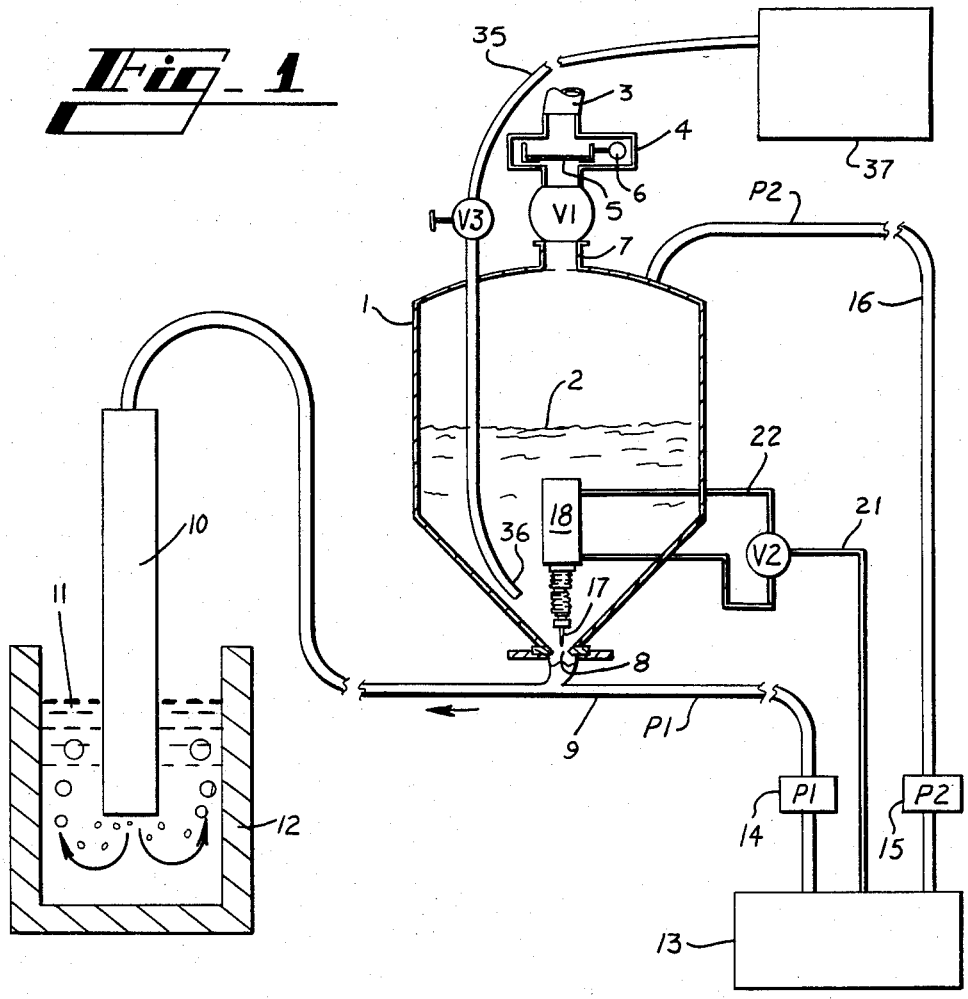
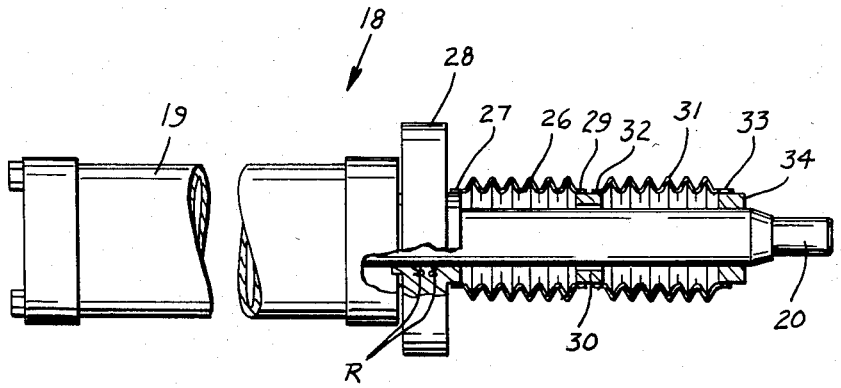
Fig. 2

SYSTEM FOR PREVENTING CLOGGING OF THE OUTLET ORIFICE OF A DISPENSER TANK CONTAINING POWDERED REAGENT AND AUXILIARY TANK DISCHARGE MEANS

This application is a continuation of application Ser. No. 246,703 filed Mar. 23, 1981, now abandoned.

TECHNICAL FIELD

A finely powdered reagent such as Calcium Carbide, Salt Coated Magnesium, Calcium Silicone and the like is supplied to molten ferrous metal in order to effect a desulphurizing or alloying action or both as is explained in U.S. Pat. No. 3,929,464 issued Dec. 30, 1975 and titled Desulphurization of Molten Ferrous Metals.

BACKGROUND ART

Known dispenser tanks containing powdered reagent and having an orifice through which the powdered reagent may flow into a carrier gas conduit arranged to receive and to convey the powdered reagent to a point of use such as a pool of molten metal have a tendency to operate improperly due to the formation of lumps or globules of reagent or introduction of foreign matter particles which tend to interfere with or to close entirely the outlet orifice of the dispenser tank.

One known system in which a dispenser tank having a funnel shaped structure leading to an outlet orifice and having a cone shaped closure element is disclosed in U.S. patent application Ser. No. 142,648 filed Apr. 22, 1980.

DISCLOSURE OF INVENTION

For the purpose of preventing partial or complete blockage of the outlet orifice of a dispenser tank and in accordance with one feature of this invention, a reciprocable plunger is mounted within the dispenser tank and is provided with operating means whereby the plunger is caused to reciprocate through the outlet orifice so as to crumble any globules of powdered reagent accumulated at the outlet and which may interfere with the proper discharge of reagent during operation of the system.

According to another feature of this invention the closure element for the orifice is configured in such manner as to provide space for accommodating powdered reagent located adjacent the dispenser tank orifice so as to prevent impactment of the reagent at the orifice, the reciprocable operating means for the closure element and plunger being enclosed by extensible enclosing means which prevents abrasive action of the powdered reagent with respect to the reciprocable operating means, and emergency discharge means in the form of a conduit which extends through a wall of the dispenser chamber may be provided and is controlled by a control valve outside the dispenser tank so that pressure within the dispenser tank may be utilized to discharge powdered reagent from the tank into a collector tank for subsequent use after the emergency condition is corrected.

BRIEF DESCRIPTION OF THE DRAWINGS

In the drawings:

FIG. 1 is a schematic diagram of a powdered reagent dispensing system which incorporates features of this invention;

FIG. 2 is an enlarged partially broken away view of the operating means for reciprocating a plunger through the outlet orifice of a dispenser tank and for moving the tank orifice closure element between open to closed positions;

BEST MODE OF CARRYING OUT THE INVENTION

Figure 3:
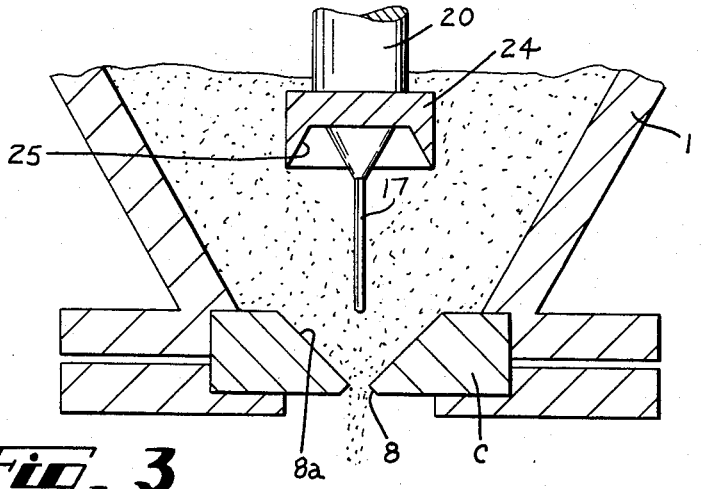
FIG. 3 is an enlarged cross sectional view of the lower portion of a dispenser tank showing its orifice, a plunger constructed according to this invention as well as the closure element configured according to a feature of this invention, the parts being shown with the closure element and plunger in the uppermost orifice open position.

In FIG. 1 the numeral 1 designates a dispenser tank including a supply of powdered reagent 2. Reagent is supplied through a conduit 3 from a source not shown into a receiver chamber 4 in which a screen filter 5 is mounted for jostling vibratory movement imparted thereto by vibrator 6. Valve V1 controls the inlet 7 to tank 1 so that during filling operations, valve V1 of course is open whereas this valve is closed during normal operating conditions during which powdered reagent 2 is supplied through orifice 8 into carrier gas conduit 9 for transmission through conduit 9 and lance 10 into the pool 11 of molten metal in ladle 12.

Convey gas at pressure P1 is supplied from reservoir 13 and pressure regulator 14 to conduit 9. Pressure P2 within dispenser tank 1 is maintained at a level in excess of pressure P1 in conduit 9 by means of regulator 15 disposed in conduit 16 which interconnects fluid reservoir 13 and dispenser tank 1.

Thus under normal conditions the higher pressure P2 forces powdered reagent 2 through the outlet orifice 8 and into conduit 9 through which it is conveyed by carrier gas under pressure P1 into the pool of molten metal 11 so long as the orifice 8 is in opened condition as represented in FIGS. 1 and 3.

Figure 4:
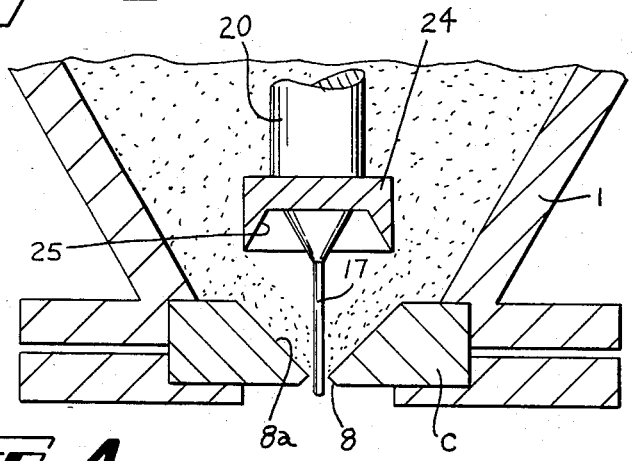
FIG. 4 is a view similar to FIG. 3 but which depicts the plunger during its passage through the dispenser tank orifice and FIG. 5 is similar to FIGS. 3 and 4 and shows the closure element and plunger in their lowermost orifice closing positions.
Figure 5:
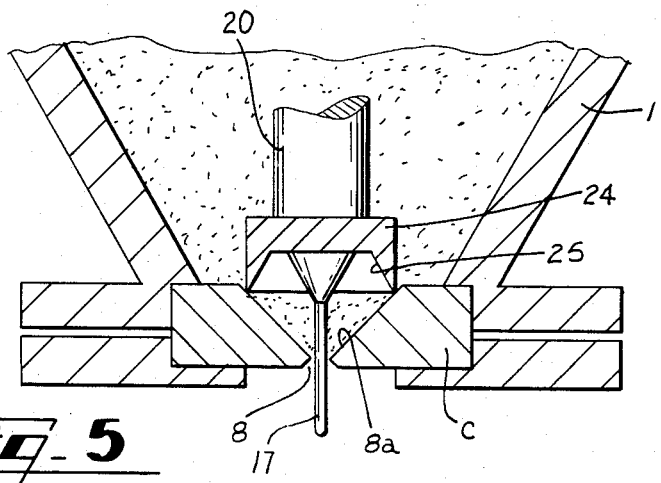

Because of their characteristics some reagents tend to lump up, especially when exposed to moisture. Occasionally foreign matter, such as slag, rust, paper fasteners and the like are also found in the reagent. Since the orifice 8 opening is small, these lumps or foreign matter or both may partially or completely close the orifice 8. In order to overcome this condition and in accordance with one feature of the invention, a reciprocable plunger 17 having a diameter less than the diameter of orifice 8 is arranged for reciprocable movement through the orifice 8 as is represented by FIGS. 3, 4 and 5. Such movement of course crumbles the globules or foreign matter which interfere with the free passage of reagent through orifice 8 and such crumbled material then is swept away through conduit 9 in the normal manner. For the purpose of imparting reciprocable movement to plunger 17, operating means 18 is provided and includes a cylinder 19 and its associated piston (not shown in the drawings) to which piston rod 20 is connected. Operating movement is imparted to the piston within cylinder 19 by pressure gas from reservoir 13 supplied through conduit 21 valve V2 and either conduits 22 or 23 as is obvious from FIG. 1 so as to impart up and down movement to plunger 17 and the piston rod 20. Valve V2 is of the four-way type and is of well known construction. This valve may be operated manually by an observant operator who by suitable instruments realizes that the orifice 8 is partially or completely clogged. Valve V2 also could be operated automatically in response to a changed condition such as increased flow of gas in line 9, or a reduction in the material rate of flow in the system as is obvious to those skilled in the art. Alternatively the valve V2 may be operated at timed intervals so that whether the orifice 8 is clogged or not the reciprocable plunger 17 in timed sequence reciprocates through the orifice 8 and ensures that any obstacle is removed.

The closure element for orifice 8 is specially configured according to this invention in order to prevent compacting powdered reagent by trapping the reagent between the closure element 24 and the orifice 8. Thus as is apparent particularly in FIGS. 3, 4 and 5, the closure element 24 is hollowed as indicated at 25 to provide a generally cup-shaped configuration. Also closure element 24 engages a part of the tank which is adjacent to but spaced from the orifice 8. Thus as the plunger 20 moves downwardly any powdered reagent in the vicinity of orifice 8 is not compacted in such manner as to close off the orifice 8 but instead is provided with space 25 which accommodates the powdered reagent disposed below closure element 24 and thus prevents packing or clogging of the finely powdered reagent at the orifice 8 which could be caused by the downward motion of closure element 24.

Since the powdered reagent 2 is finely divided material and because pressure within dispenser tank 1 is sometimes higher than the operating pressure supplied to cylinder 19, it is desirable to isolate the interior of cylinder 19 as well as the exterior of the piston rod 20 from contact with the abrasive reagent 2 and from the pressure within dispenser tank 1 and to prevent the powdered reagent from contacting the sealing rings R. Toward this end a first bellows 26 is secured at 27 in fluid tight manner to supporting flange 28. At its right hand end, bellows 26 is secured at 29 in fluid tight relation to spacer ring 30 which is disposed about piston rod 20 and through which that rod is reciprocable. A second bellows 31 is secured at 32 by fluid tight connection with spacer ring 30 and is secured at 33 to ring 34 secured to piston rod 20 and movable therewith. Thus as the piston rod 20 reciprocates to and fro, the bellows structure 26 and 31 extends and contracts and all the while serves to isolate the interior of cylinder 19 and the exterior of piston rod 20 from reagent 2 and from the pressure within dispenser tank 1. Sealing rings R are arranged to provide a fluid tight relation between the aperture formed in flange 28 and the exterior surface of piston rod 20 which is reciprocable through the aperture in flange 28 as well as a mechanical guide for the piston rod 20.

With reference to FIGS. 3, 4 and 5, it is apparent that downward motion of plunger 17 to the position represented in FIG. 4 effectively removes any globules of powdered reagent that may partially or completely clog the orifice 8. Furthermore, the space 25 in cup-shaped closure element 24 provides accommodation for any powdered reagent in close proximity to the orifice 8 so that orifice closing motion of closure element 24 does not itself compact the powdered reagent and thus effectively block the passage 8.

It is possible that impurities such as small granules, rag, rust, slag and metallic fragments may effectively clog the orifice 8 and such clogging action may not be fully relieved by reciprocable action of plunger 17. Such a condition is difficult to relieve and may even be quite hazardous. Thus in order to facilitate corrective action, it is desirable first to remove any powdered reagent 2 which may be within the dispenser 1 when such firmly clogged condition develops. Toward this end a discharge conduit 35 may be provided and arranged with its inner end 36 closely adjacent the orifice 8. Valve V3 can then be opened so that pressure P2 effectively drives the reagent 2 upwardly through conduit 35 and into collector tank 37 where the reagent may be retained temporarily for subsequent loading into the dispenser 1 for later reuse.

INDUSTRIAL APPLICABILITY

This invention is well suited for use in conjunction with known systems for dispensing powdered reagent into molten metal for the purpose of desulphurization, alloying or both because it substantially diminishes or eliminates the difficulties and waste of time and effort normally required to correct a clogged orifice in a dispenser tank in systems of this nature.

We claim:

1. In a system for discharging powdered reagent from a dispenser tank under pressure $P_2$ and having a discharge orifice in communication with a carrier gas conduit under pressure $P_1$ which is less than pressure $P_2$ and which is arranged to receive and to convey the powdered reagent to a point of use, an arrangement including a plunger having a diameter less than the diameter of said orifice and being reciprocably movable through said orifice for engaging and crumbling globules of material which are of sufficient size and orientation as to interfere with normal discharge of powdered reagent through said orifice, fluid actuated operating means disposed within said tank and having an operating cylinder and piston which are subjected to operating pressure which is isolated from the pressure $P_2$ and from the powdered reagent within said dispenser tank for imparting reciprocable movement to said plunger, and a closure element mounted on and movable with said plunger and arranged to engage and to disengage a part of said dispenser tank adjacent to but spaced from said orifice so as effectively to prevent and to allow passage of reagent through said orifice respectively, said closure element being larger than said orifice such that compaction of powdered reagent in close proximity to said orifice may tend to clog said orifice, said closure element being configured to provide space for accommodating powdered reagent which is in close proximity to said orifice thereby to prevent clogging of said orifice by said powdered reagent.

2. An arrangement according to claim 1 wherein said operating means includes an operating piston having a piston rod interconnected with said plunger and an associated cylinder, and means for supplying fluid under pressure to said cylinder so as to impart reciprocable movement to said piston.

3. An arrangement according to claim 2 wherein extensible enclosing means is disposed about at least a part of said piston rod and in fluid tight relation therewith and in fluid tight relation with the end of said cylinder through which said piston rod is reciprocable so as to isolate the interior of said cylinder from fluid pressure outside said cylinder and within said dispenser tank.

4. An arrangement according to claim 3 wherein said extensible enclosing means includes a bellows structure.

5. An arrangement according to claim 4 wherein said bellows structure comprises a pair of coaxial bellows and a rigid spacer ring interposed therebetween and in fluid tight relation therewith and through which said piston rod is reciprocable.

6. An arrangement according to claim 1 wherein said closure element is of cup-shaped configuration.

7. An arrangement according to claim 1 wherein a discharge conduit is arranged to extend through a wall of said dispenser tank with its outer end in communication through a valve with a collector tank for receiving powdered reagent discharged from said dispenser tank.

8. An arrangement according to claim 7 wherein the inner end of said discharge conduit is disposed adjacent to but spaced from said orifice.

9. In a system for discharging powdered reagent from a dispenser tank having a discharge orifice in communication with a carrier gas conduit arranged to receive and to convey the powdered reagent to a point of use, an arrangement for closing said orifice comprising a closure element arranged to engage and to disengage a part of said dispenser tank adjacent to but spaced from said orifice so as effectively to close and open said orifice, a piston and cylinder mounted within said dispenser chamber and arranged to open and close said closure element, extensible enclosing means in fluid tight relation with said piston and cylinder so as to prevent undue abrasion thereof due to contact with powdered reagent, a plunger secured to and movable with said closure element and reciprocably movable through said discharge orifice for engaging and crumbling globules of material within and adjacent said orifice, said plunger having a diameter less than said orifice, and a discharge conduit arranged to extend through a wall of said dispenser tank with its outer end in communication through a valve with a collector tank for receiving powdered reagent discharged from said dispenser tank.

* * * * *